US006139636A

United States Patent [19]

Huang et al.

[11] Patent Number: 6,139,636

[45] Date of Patent: Oct. 31, 2000

[54] SPRAY COATING DEVICE

[75] Inventors: Kuo-Feng Huang, Chu-Pei; Kuo-Chen Wang, Hsinchu Hsien; Ming-Che Yang; Hsien-Jung Hsu, both of Kaohsiung, all of Taiwan

[73] Assignee: United Microelectronics Corp., Hsinchu, Taiwan

[21] Appl. No.: 09/189,846

[22] Filed: Nov. 12, 1998

[51] Int. Cl.[7] ..... B05B 13/04

[52] U.S. Cl. ..... 118/320; 118/52; 118/315; 427/240; 427/425

[58] Field of Search ..... 427/240, 425; 118/52, 320, 315; 239/548

[56] References Cited

U.S. PATENT DOCUMENTS 5,415,753 5/1995 Hurwitt et al. ..... 204/192.12
5,571,560 11/1996 Lin ..... 427/240
5,759,614 6/1998 Tomoeda et al. ..... 427/8
5,962,070 10/1999 Mitsuhashi et al. ..... 427/240
5,972,426 10/1999 Kutsuzawa et al. ..... 427/240

*Primary Examiner*—Shrive Beck
*Assistant Examiner*—Jennifer Calcagni
*Attorney, Agent, or Firm*—Oblon, Spivak, McClelland, Maier & Neustadt, P.C.

[57] ABSTRACT

A spray coating device for coating a rotating wafer according to the invention is disclosed. The spray coating device comprises a spray head having a plurality of spray holes which are located on one end thereof with more in number on both sides than on the center of the end for uniformly spraying a chemical liquid on the rotated wafer. Since spray holes are more in number on the both sides than on the center of the end, the rotated wafer can be uniformly spray coated with the chemical liquid even though several spray holes are congested.

5 Claims, 4 Drawing Sheets

SPRAY COATING DEVICE

BACKGROUND OF THE INVENTION

1. Field of the Invention

The invention relates to a spray coating device, and in particular to a spray coating device for developing for improving coating uniformity.

2. Description of the Related Art

It is well known that photolithography is one of the most important steps in the semiconductor process. Any regions related to the structure of semiconductor devices, such as subsequently pattered and doped regions, are all defined by photolithography. Thus, the complexity of the semiconductor process depends on the times of photolithography performed and the number of masks used.

Although the photolithography is complicated, the principle thereof is quite simple. To perform the photolithography, a photo-sensitive material is first formed on a wafer. A parallel light coming from a light source passes through a glass-based mask and irradiates the photo-sensitive material. At the same time, a pattern on the mask is projected onto the photo-sensitive material. A selective photo-sensitive reaction is performed to accomplish a pattern transfer. In general, the photo-sensitive material is called a photoresist.

In addition to the light source, the mask and the photoresist layer, a developer is needed for developing during photolithography. Basically, the step of developing includes: (1) coating a photoresist layer; (2) exposing the photoresist layer; and (3) developing the exposed photoresist layer.

As to the developing, the exposed photoresist layer is developed to display a transferred pattern by cleaning out exposed parts of the photoresist layer with a neutral reaction. To avoid unexposed parts of the photoresist layer from being attacked by a developer, the conditions of developing, such as developing time, the concentration of the developer and developer temperature, must be strictly controlled. Typically, it is necessary to have enough time to expose a photoresist layer through a mask, such that exposed parts of the photoresist layer can completely neutrally react with the developer later. Moreover, developing time cannot be too long to surpass the line width tolerance of a desired photoresist pattern. On the other hand, the concentration of the developer can cause a direct effect during photolithography. The higher the concentration of the developer, the shorter the exposing time for the photoresist layer and the higher the throughput in the developing process. However, a poor resolution on a formed photoresist pattern occurs. Therefore, to obtain a desired photoresist pattern, the conditions of developing depend on the required line width and accuracy thereof. As to the temperature, the developer is maintained at a temperature of approximately 23° C.

FIG. 1 is a schematic side view showing a conventional spray coating device 8 in an MKV development machine manufactured by TEL. Referring to FIG. 1, a developer 16 is transmitted to a spray head 14 via two inlet tubes 12, then sprayed on a wafer 18 from a plurality of spray holes 20. When spray coating the wafer 18, the wafer 18 is concurrently rotated one turn with a fixed axis 10 mounted at the center of the spray coating device 8 as a center.

Referring to FIG. 2, a top view of the spray coating device 8 is shown for better understanding how the distribution of the spray holes 20 is. As shown in FIG. 2, the spray holes 20 has a uniform distribution in number. During spray coating, each spray hole 20 emits the same amount of developer 16.

However, since the center part of the rotated wafer 18 has faster moving speed than the surrounding part thereof, the center part is applied with more amount of developer than the surrounding part. That is, the center part and the surrounding part of the rotated wafer 18 have different amounts of developer 16 sprayed thereon.

To further describe different amounts of developer 16 sprayed on the center part and the surrounding part of the wafer 18, the distributions of path length and spray amount of developer on a rotated wafer, respectively, according to the prior art are shown in FIGS. 3A–3B. Referring to FIG. 3A, x-axis represents a distance away from the center of the rotated wafer with its origin severing as the center while y-axis represents a corresponding path length of developer sprayed on the rotated wafer. As shown in FIG. 3A, the path length is equal to $2\pi r$, wherein r is a distance away from the center of the rotated wafer. Obviously, at the center of the rotated wafer, the corresponding path length is equal to 0. Referring to FIG. 3B, x-axis represents a distance away from the center of the rotated wafer 18 with its origin severing as the center while y-axis represent a corresponding spray amount per unit length on the rotated wafer. If each spray hole has a spray amount of $\Delta m$, the spray amount per length on a corresponding path length is equal to $\Delta m/2\pi r$. It is reasonable that the spray amount at the center of the rotated wafer is $\Delta m$ because the center is static. As can be seen from FIG. 3B, a path length closer to the center of the rotated wafer has a larger spray amount per unit length. Therefore, the center part of the rotated wafer has a larger spray amount per unit length than the surrounding part thereof. As a result, the center part of the rotated wafer is more easily over developed while the surrounding part thereof is more easily insufficiently developed, resulting in low manufacturing yield.

Additionally, when some of spray holes, especially corresponding to the surrounding part of the rotated wafer are congested, the tolerance thereof becomes smaller, obvious leading to a poor uniformity of spray coating.

SUMMARY OF THE INVENTION

In view of the above, an object of the invention is to provide a spray coating device for developing which is designed with a non-uniform distribution of spray holes instead of a uniform distribution thereof in number as described in the prior art for preventing over developing and/or insufficient developing.

To achieve the above-stated object, the spray coating device of the invention comprises a spray head having a plurality of spray holes which are located on one end thereof with more in number on both sides than on the center of the end for uniformly spraying a chemical liquid on a rotated wafer.

BRIEF DESCRIPTION OF THE DRAWINGS

The invention will be more fully understood from the detailed description given hereinbelow and the accompanying drawings which are given by way of illustration only, and thus do not limit the present invention, and wherein.

DETAILED DESCRIPTIONS OF THE PREFERRED EMBODIMENTS

Figure 4:
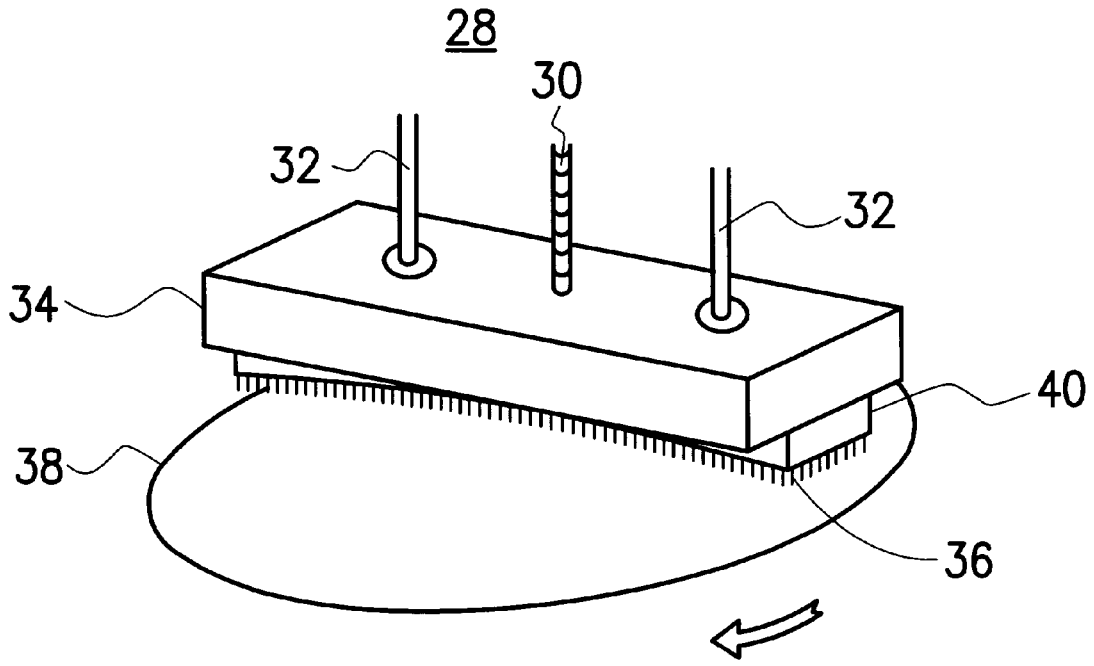
FIG. 4 is a schematic side view showing a spray coating device according to a preferred embodiment of the invention.

FIG. 4 is a schematic side view showing a spray coating device 28 according to a preferred embodiment of the invention.

Figure 5:
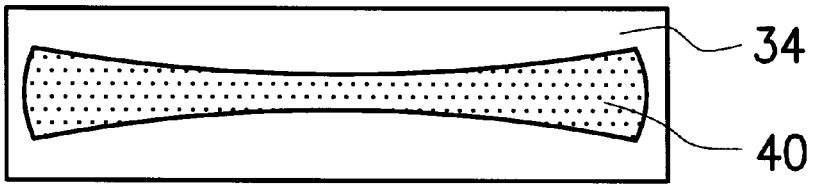
FIG. 5 is a schematic bottom view of the spray coating device shown in FIG. 4.

As shown in FIG. 4, a spray coating device 28 used for, for example, developing includes a spray head 34 having a plurality of spray holes 40 which are located on one end thereof with more in number on both sides than on the center of the end, and two inlet tubes 32 mounted on both sides of the other end of the spray head 34. A chemical liquid 36, such as a developer, is transmitted to the spray head 34 via the two inlet tubes 32, then sprayed out on a rotated wafer 38 from the spray holes 40. FIG. 5 is a schematic bottom view of the spray coating device shown in FIG. 4 where the spray holes 40 has a fan-shaped distribution in number. When spray coating the wafer 38, the wafer 38 is concurrently rotated one turn with a fixed axis 30 mounted at the center of the spray head 34 as a center.

Figure 6A:
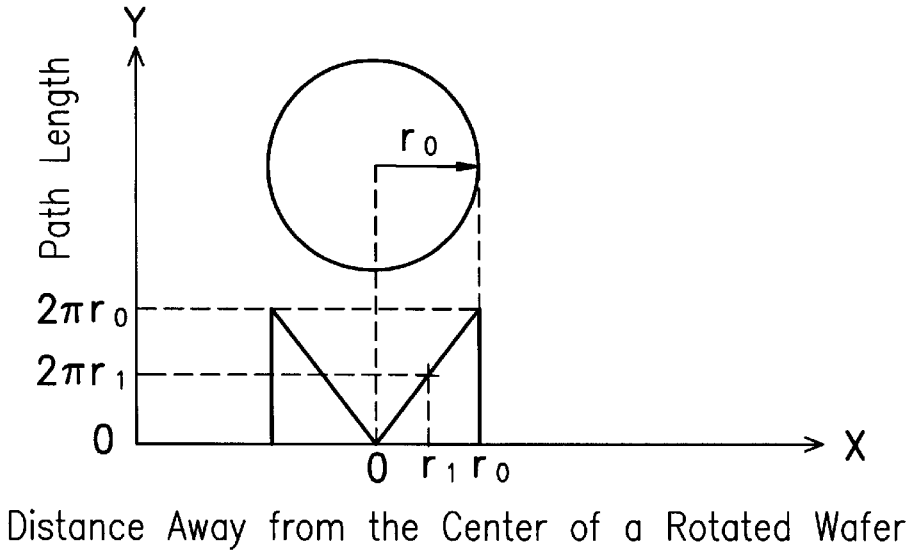
FIGS. 6A, 6B, and 6C are graphics showing the distributions of path length, the number of spray holes per area and spray amount per unit length on a rotated wafer according to the invention.
Figure 6B:
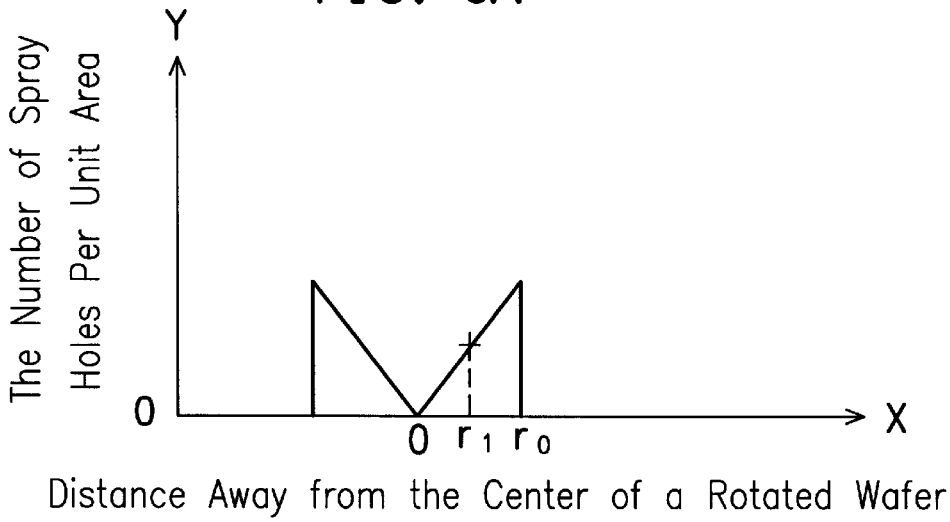
Figure 6C:
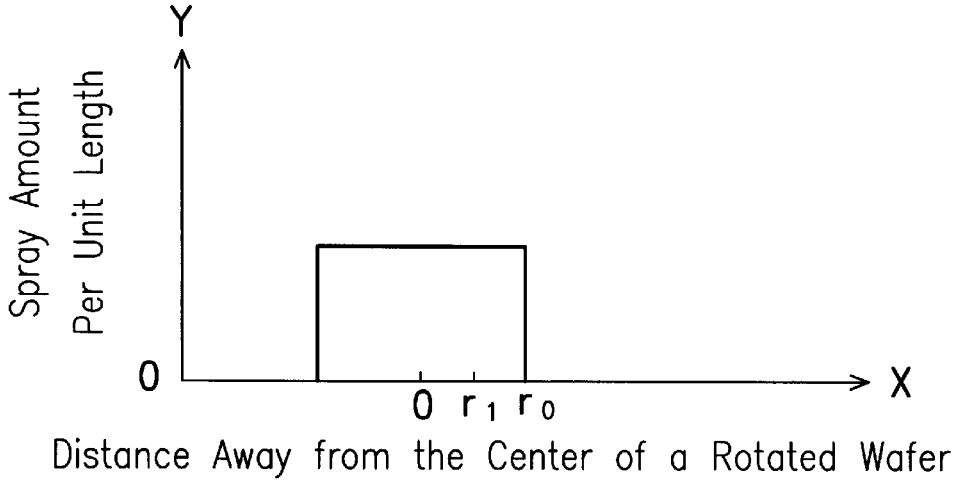

To better understand a spray coating device of the invention which can uniformly spray coat a rotated wafer, the distributions of path length, the number of spray holes per area and spray amount per unit length on a rotated wafer according to the invention are shown in FIGS. 6A–6C.

Figure 1:
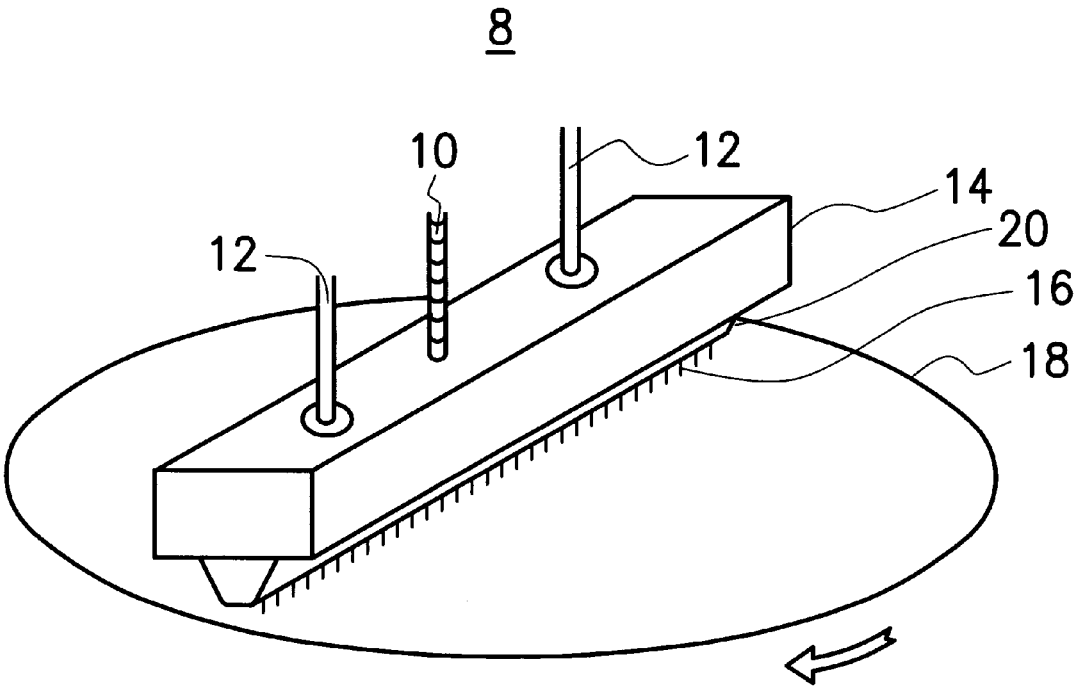
FIG. 1 (PRIOR ART)
FIG. 1 is a schematic side view showing a conventional spray coating device used in an MKV development machine manufactured by TEL.
Figure 2:
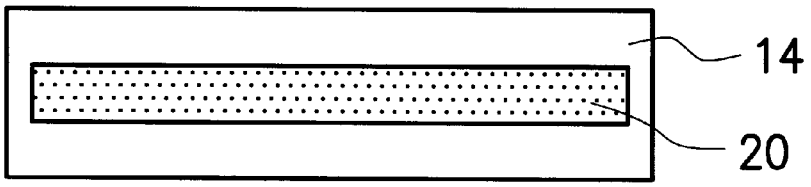
FIG. 2 (PRIOR ART)
FIG. 2 is a top view of the conventional spray coating device shown in FIG. 1.
Figure 3A:
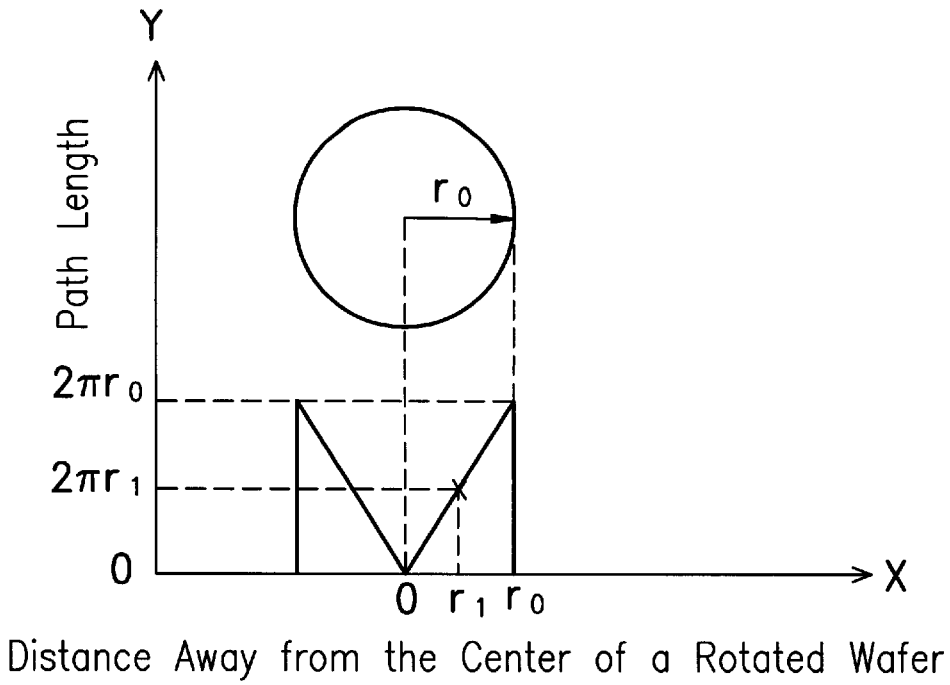
FIG. 3A (PRIOR ART)
FIGS. 3A and 3B are graphics showing distributions of path length and spray amount per unit length on a rotated wafer, respectively, according to the prior art.
Figure 3B:
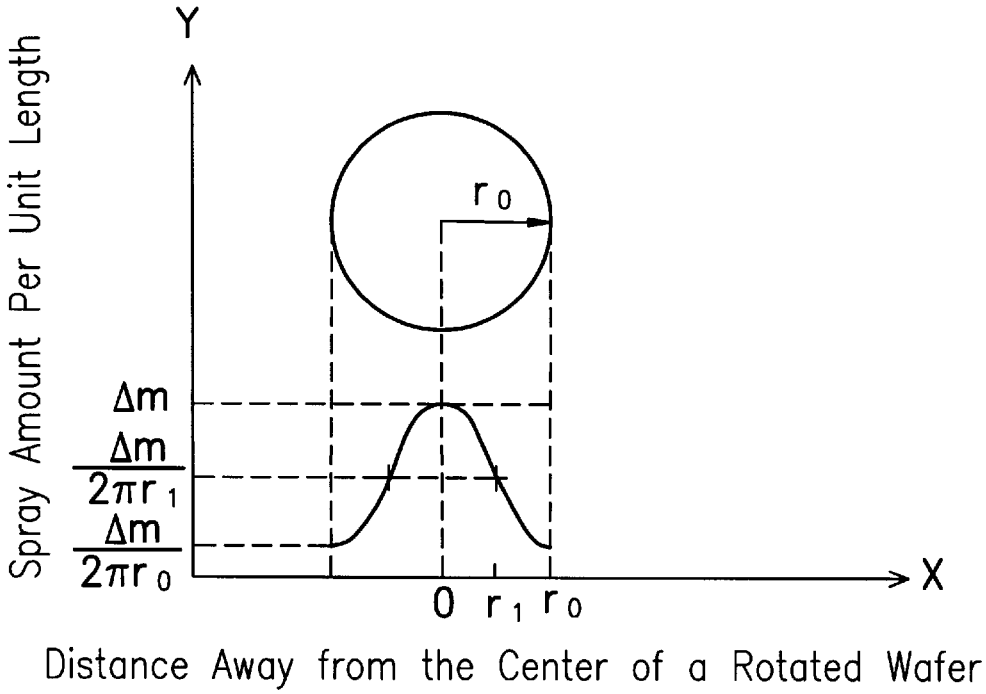
FIG. 3B (PRIOR ART)

Referring to FIG. 3A, x-axis represents a distance away from the center of a rotated wafer with its origin severing as the center while y-axis represents a corresponding path length of developer sprayed on the rotated wafer. The path length is equal to $2\pi r$, wherein r is a distance away from the center of the rotated wafer. Obviously, at the center of the rotated wafer, the corresponding path length is equal to 0. Next, referring to FIG. 6B, x-axis represents a distance away from the center of the rotated wafer with its origin severing as the center while y-axis represents the number of corresponding spray holes per unit area. As shown in FIG. 6B, spray holes are more in number on the both sides than on the center of a spray head. Referring now to FIG. 6C, x-axis represents a distance away from the center of the rotated wafer with its origin severing as the center while y-axis represents a corresponding spray amount per unit length on the rotated wafer. As can be seen from FIGS. 6A, 6B and 6C, the shorter the path length is, the less the number of spray holes and the spray amount per unit length will be. Inversely, the longer the path length is, the more the number of spray holes and the spray amount per unit length will be. Under this circumstance, even though one or two spray holes are congested, the spray coating device still has a higher tolerance.

Accordingly, a spray coating device in accordance with the invention designed with spray holes having more in number on both sides than on the center thereof can uniformly spray a chemical liquid on a rotated wafer.

While the invention has been described by way of example and in terms of the preferred embodiment, it is to be understood that the invention is not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A spray coating device for spray coating a rotating wafer comprising:

an elongated spray head extending substantially across the entire width of the rotating wafer, having a center portion and two end portions, and having a plurality of spray holes with a uniform size, wherein a number of the spray holes located at the center portion of the elongated spray head is less than a number of the spray holes located at each end portion of the elongated spray head, and the plurality of spray holes is distributed on the elongated spray head based on a path length traveled by a respective one of the plurality of spray holes over the rotating wafer for uniformly spraying a chemical liquid on the rotating wafer.

2. The spray coating device as claimed in claim 1, wherein the chemical liquid is a developer.

3. The spray coating device as claimed in claim 1, wherein the plurality of spray holes is distributed on the elongated spray head in a fan shape.

4. The spray coating device as claimed in claim 1, wherein as the rotating wafer is being coated, the rotating wafer is rotated one turn.

5. The spray coating device as claimed in claim 1, further comprising two inlet tubes respectively mounted on each end portion of the elongated spray head.

* * * * *